US010446953B1

(12) United States Patent
Raby

(10) Patent No.: US 10,446,953 B1
(45) Date of Patent: Oct. 15, 2019

(54) ELECTRICAL CONNECTOR

(71) Applicant: RabyConnectInc., Boisbriand (CA)

(72) Inventor: Roland Dominique Raby, Boisbriand (CA)

(73) Assignee: RABYCONNECTINC., Boisbriand (CA)

( * ) Notice: Subject to any disclaimer, the term of this patent is extended or adjusted under 35 U.S.C. 154(b) by 0 days.

(21) Appl. No.: 16/002,201

(22) Filed: Jun. 7, 2018

(51) Int. Cl.
*H01R 9/24* (2006.01)
*H01R 4/50* (2006.01)
*H01R 4/38* (2006.01)

(52) U.S. Cl.
CPC ..... *H01R 9/2416* (2013.01); *H01R 4/38* (2013.01); *H01R 4/5091* (2013.01)

(58) Field of Classification Search
CPC ..... H01R 4/28; H01R 4/301; H01R 4/302; H01R 4/305; H01R 4/307; H01R 4/308; H01R 4/34; H01R 4/364; H01R 4/38; H01R 4/42; H01R 4/46; H01R 9/2416; H01R 4/363; H01R 4/36; H01R 4/366; H01R 4/2408; H01R 4/48; H01R 9/24; H01R 13/514; H01R 13/5205; H01R 4/304; H01R 4/32; H01R 4/70; H01R 9/031
USPC ..... 439/775, 778, 780, 781, 782, 784, 785, 439/790–798
See application file for complete search history.

(56) References Cited

U.S. PATENT DOCUMENTS 1,336,290 A 4/1920 Finkelstein
2,196,383 A 4/1940 Buchanan
2,290,691 A 7/1942 Lemont
3,033,913 A 5/1962 Dietze
3,372,361 A 3/1968 Wengen
3,629,806 A 12/1971 Wiechmann
3,638,172 A 1/1972 Adam
4,027,940 A 6/1977 Mazzeo
4,072,393 A 2/1978 McDermott
4,269,465 A * 5/1981 Mueller ..... H01R 4/36 439/431
4,324,949 A 4/1982 Grandjean
4,352,537 A * 10/1982 Guelden ..... H01R 4/2404 439/425
4,795,365 A 1/1989 Johnston et al.
4,878,855 A 11/1989 Heng et al.
(Continued)

FOREIGN PATENT DOCUMENTS

EP 163361 12/1985
EP 763871 4/1999
(Continued)

*Primary Examiner* — Edwin A. Leon
*Assistant Examiner* — Matthew T Dzierzynski

(57) ABSTRACT

A connector for electrically connecting to a conductor, the connector including a terminal provided with an electrical contact made of an electrically conducting material, a clamping element for clamping the conductor against the electrical contact and an actuator. A conducting element extends from the electrical contact. The clamping element is movable by the actuator between clamping element open and closed configurations. The actuator is configurable between first and second configurations. In the first configuration, the actuator is only operable to move the clamping element towards the closed configuration. In the second configuration, the actuator is operable to move the clamping element towards the open configuration.

20 Claims, 5 Drawing Sheets

(56) References Cited

U.S. PATENT DOCUMENTS

| | | | | |
|---|---|---|---|---|
| 5,032,092 | A * | 7/1991 | Linn | H01R 9/24 439/723 |
| 5,041,012 | A * | 8/1991 | Caprio | H01R 4/2408 439/409 |
| 6,863,558 | B2 | 3/2005 | Negishi et al. | |
| 7,090,532 | B1 * | 8/2006 | Kaine | H01R 13/5205 439/523 |
| 7,090,544 | B2 * | 8/2006 | Campbell | H01R 4/2408 439/411 |
| 7,104,832 | B2 * | 9/2006 | Campbell | H01R 4/363 439/411 |
| 7,699,669 | B2 * | 4/2010 | Sweeney | H01R 4/366 439/791 |
| 8,616,913 | B2 | 12/2013 | Rundle | |
| 9,082,560 | B2 * | 7/2015 | Helms | H01H 1/06 |
| 9,153,881 | B2 * | 10/2015 | Vanzetto | H01R 4/366 |
| 9,287,637 | B2 * | 3/2016 | Therrien | H01R 4/32 |
| 9,929,477 | B2 * | 3/2018 | Beiler | H01R 4/366 |
| 2012/0238154 | A1 * | 9/2012 | Bishop | H01R 4/4836 439/709 |
| 2016/0149342 | A1 * | 5/2016 | Rodriguez | H01R 13/62922 439/157 |

FOREIGN PATENT DOCUMENTS

| | | | | |
|---|---|---|---|---|
| EP | 1213792 | | 12/2003 | |
| EP | 2518831 | | 10/2012 | |
| FR | 2744288 | | 8/1997 | |
| JP | 1112675 | | 5/1989 | |
| WO | WO-9728577 | A1 * | 8/1997 | H01R 4/2408 |

* cited by examiner

ELECTRICAL CONNECTOR

FIELD OF THE INVENTION

The present invention relates to the filed of electricity. More specifically, the present invention is concerned with an electrical connector.

BACKGROUND OF THE INVENTION

Electrical connectors are used to attach electrical wires, cables and similar conductors to each other or to devices. Such connectors often include a static element and a movable clamp or fastener. To secure the conductor to the electrical connector, the clamp or fastener is used to press the conductor against the static element. Typically, the static element is electrically conductive and conducts electrical currents from and to the conductor.

One problem that may occur in such connectors is that in use, or through an unintentional action of a user, the clamp or fastener may loosen, which reduces the clamping force with which the conductor is retained. Therefore, there is a chance that the conductor becomes unintentionally disconnected from the connector. Also, even if the conductor remains attached to the connector when the clamping force is reduced, it is possible that the contact between the conductor and the static element becomes intermittent or that this contact occurs over a smaller surface of the conductor than intended. This can greatly increase electrical resistance in the electrical connector, and could lead to unintended heat production, which can even lead to a fire.

There is also a risk when connecting two wires with a conventional twist-on wire connector that the connector falls. This would expose the conducting parts of the wire and cause an electrocution risk.

Against this background, there exists a need in the industry to provide improved electrical connectors. An object of the present invention is to provide such electrical connectors.

SUMMARY OF THE INVENTION

In a broad aspect, there is provided a connector for electrically connecting to a first conductor, the connector comprising: a first terminal for receiving the first conductor, the first terminal being provided with a first electrical contact made of an electrically conducting material, a first clamping element for clamping the first conductor against the first electrical contact by clamping the first conductor between the first electrical contact and the first clamping element, and a first actuator, the first clamping element being movable between a first clamping element open configuration and a first clamping element closed configuration, wherein, in the first clamping element closed configuration, the first clamping element is closer to the first electrical contact than in the first clamping element open configuration, the first actuator being operatively coupled to the first clamping element for selectively moving the first clamping element between the first clamping element closed and open configurations; and an electrically conducting element extending from and electrically coupled to the first electrical contact; the first actuator being configurable between a first actuator first configuration and a first actuator second configuration, wherein, in the first actuator first configuration, the first actuator is only operable to move the first clamping element towards the first clamping element closed configuration, and in the first actuator second configuration, the first actuator is operable to move the first clamping element towards the first clamping element open configuration.

There may also be provided a connector wherein the connector is usable for electrically connecting the first conductor and a second conductor to each other, the connector further comprising: a second terminal for receiving the second conductor, the second terminal being provided with a second electrical contact made of an electrically conducting material, a second clamping element for clamping the second conductor against the second electrical contact by clamping the second conductor between the second electrical contact and the second clamping element, and a second actuator, the second clamping element being movable between a second clamping element open configuration and a second clamping element closed configuration, wherein, in the second clamping element closed configuration, the second clamping element is closer to the second electrical contact than in the second clamping element open configuration, the second actuator being operatively coupled to the second clamping element for selectively moving the second clamping element between the second clamping element closed and open configurations; wherein the electrically conducting element extends between the first and second electrical contacts and electrically couples the first and second electrical contacts to each other.

There may also be provided a connector wherein, in the first actuator second configuration, the first actuator is operable to selectively move the first clamping element towards each of the first clamping element closed and open configurations.

There may also be provided a connector wherein the first actuator includes a shaft terminated by a head, the shaft being threaded along a threaded portion thereof; the first clamping element defines a threaded aperture threadedly receiving at least part of the threaded portion thereinto, the first clamping element defining a clamping surface opposed to the head and facing the first electrical contact; and rotating the shaft relative to the threaded aperture moves the clamping surface relative to the first electrical contact to move the first clamping element between the first clamping element open and closed configurations.

There may also be provided a connector wherein the first actuator includes a toothed pinion; the first clamping element includes a substantially elongated toothed rack engaging the toothed pinion and defines a clamping surface extending generally perpendicular to the toothed rack; and rotating the toothed pinion moves the toothed rack relative to the toothed pinion to move the clamping surface relative to the first electrical contact to move the first clamping element between the first clamping element open and closed configurations.

There may also be provided a connector wherein the toothed pinion is coaxial with the head.

There may also be provided a connector further comprising a connector body, the first actuator being mounted to the connector body, the first actuator including a head and a toothed wheel movable axially relative to the head, the toothed wheel being also rotatable relative to the connector body jointly with the head, the first actuator also including a pawl mounted to the connector body, the pawl and toothed wheel being configured and sized so that with the pawl engaging the toothed wheel, the toothed wheel is only rotatable in a first direction and is prevented by the pawl from rotating in a second direction opposed to the first direction, the toothed wheel being movable relative to the head between an engaged position wherein the toothed wheel engages the pawl, and a disengaged position wherein the toothed wheel is disengaged from the pawl, the head being operatively coupled to the first clamping element such that rotating the head moves the first clamping element between the first clamping element open and closed configurations, the first actuator being in the first actuator first configuration when the toothed wheel is in the engaged position and the first actuator being in the first actuator second configuration when the toothed wheel is in the disengaged position.

There may also be provided a connector wherein the toothed wheel includes a plurality of teeth, each of the teeth defining a radial surface extending substantially radially and a slanted surface angled relative to the radial surface and merging with the radial surface, the pawl being configured and sized so that when the toothed wheel is rotated in the first direction, the pawl can climb the slanted surface to allow rotation of the toothed wheel in the first direction and when the toothed wheel is rotated in the second direction, the pawl stops rotation of the toothed wheel when abutting against the radial surface.

There may also be provided a connector wherein the first actuator includes an actuator biasing element biasing the toothed wheel towards the engaged position.

There may also be provided a connector wherein the head defines a head aperture extending therethrough leading to the toothed wheel, the head aperture including a head aperture moving portion and the toothed wheel defining a toothed wheel abutment portion in register with the head aperture moving portion, whereby inserting a tool through the head aperture moving portion and pushing against the toothed wheel abutment portion with the tool moves the toothed wheel to the toothed wheel disengaged position.

There may also be provided a connector wherein the head aperture also includes a head aperture pass-through portion and the toothed wheel defines a wheel pass-through aperture in register with the head pass-through portion.

There may also be provided a connector wherein the head aperture moving portion extends outwardly from the head aperture pass-through portion.

There may also be provided a connector wherein the head aperture pass-through portion is substantially square and the head aperture moving portion includes a slit.

There may also be provided a connector wherein the first clamping element defines a concave clamping surface facing the first electrical contact.

There may also be provided a connector further comprising a connector body, the first terminal being provided in the connector body and including a substantially elongated bore leading into the connector body, the first electrical contact and the first clamping element facing each laterally other across the bore.

There may also be provided a connector further comprising an obstructing element provided adjacent the first clamping element and movable jointly therewith, the obstructing element being configured to extend across the bore to prevent access to the first electrical contact when fully extended across the bore.

There may also be provided a connector further comprising a connector body, the first terminal being provided in the connector body and including a substantially elongated groove leading into the connector body, the first electrical contact and the first clamping element facing each other across the groove.

There may also be provided a connector wherein the groove is open at at least one longitudinal end thereof, the second terminal being provided with a door for selectively covering the groove while leaving the groove open at the at least one longitudinal end.

There may also be provided a connector wherein the groove is open at both longitudinal ends thereof.

There may also be provided a connector wherein the first electrical contact defines a first contact surface for contacting the first conductor, the first contact surface being concave.

There may also be provided a connector wherein the first electrical contact defines a first contact surface for contacting the first conductor, the first contact surface being provided with asperities.

Advantageously, the proposed electrical connector provides a connection that is more robust as it reduces the risk that the electrical connections in the connector will loosen unintentionally.

Other objects, advantages and features of the present invention will become more apparent upon reading of the following non-restrictive description of preferred embodiments thereof, given by way of example only with reference to the accompanying drawings.

DETAILED DESCRIPTION

Terms such as "substantially", "about" and "essentially" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Figure 1:
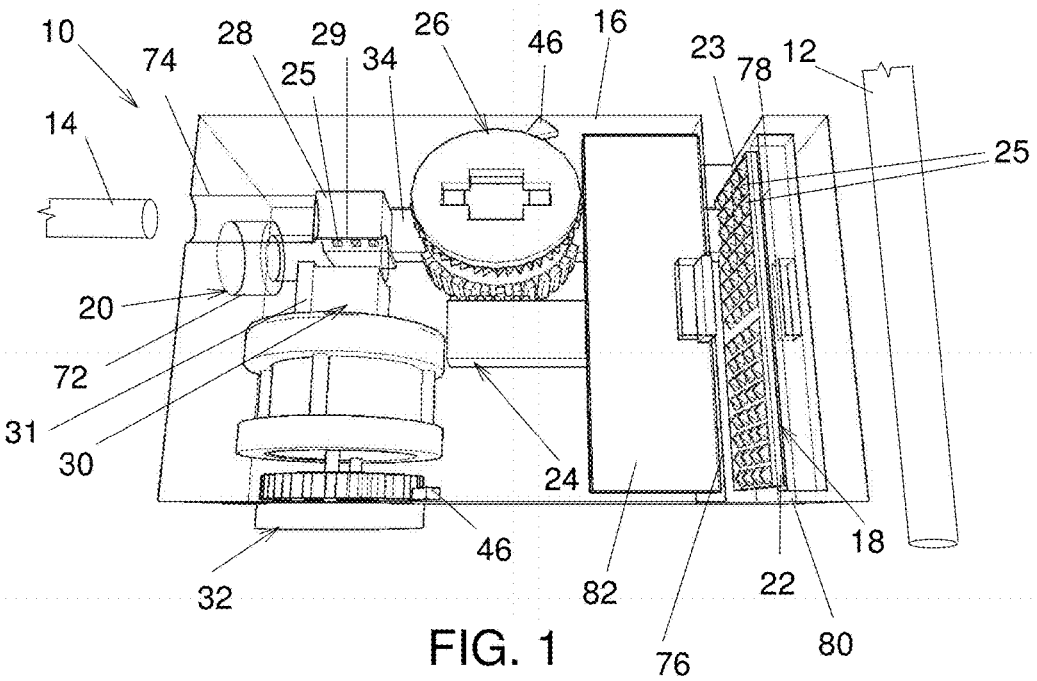
FIG. 1, in a top view with some hidden lines shown, illustrates a connector in accordance with an embodiment of the present invention, the connector being shown in a first configuration.

Referring to FIG. 1, there is shown a connector 10 for electrically connecting a first conductor 12 and a second conductor 14 to each other. The first and second conductors 12 and 14 can be electrically conducting wires, cables, or any other suitable conductors that may be covered or not with an electrically insulating sheath along a portion thereof, but which show an exposed conducting portion to be inserted in the connector 10.

Figure 9:
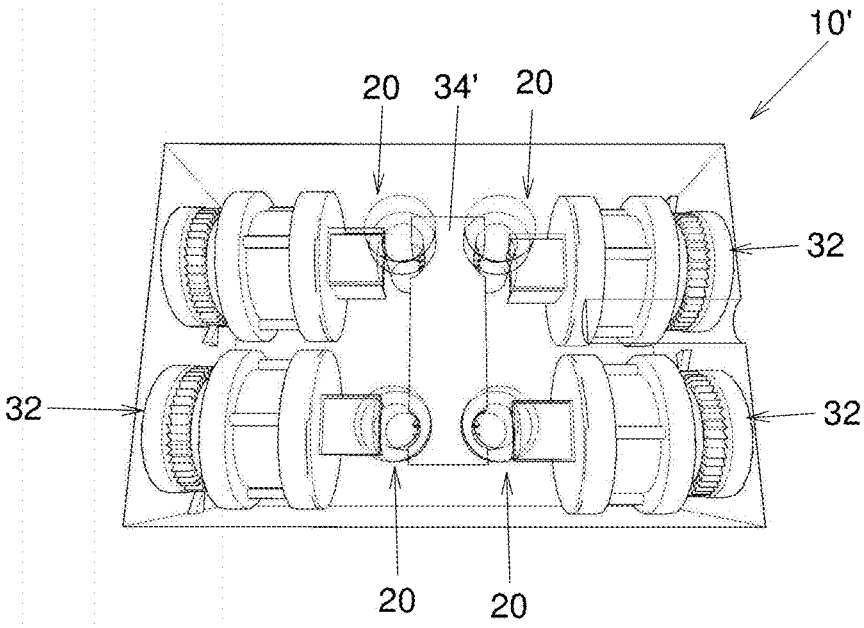
FIG. 9, in a top view with some hidden lines shown, illustrates a connector in accordance with an alternative embodiment of the present invention.
Figure 10:
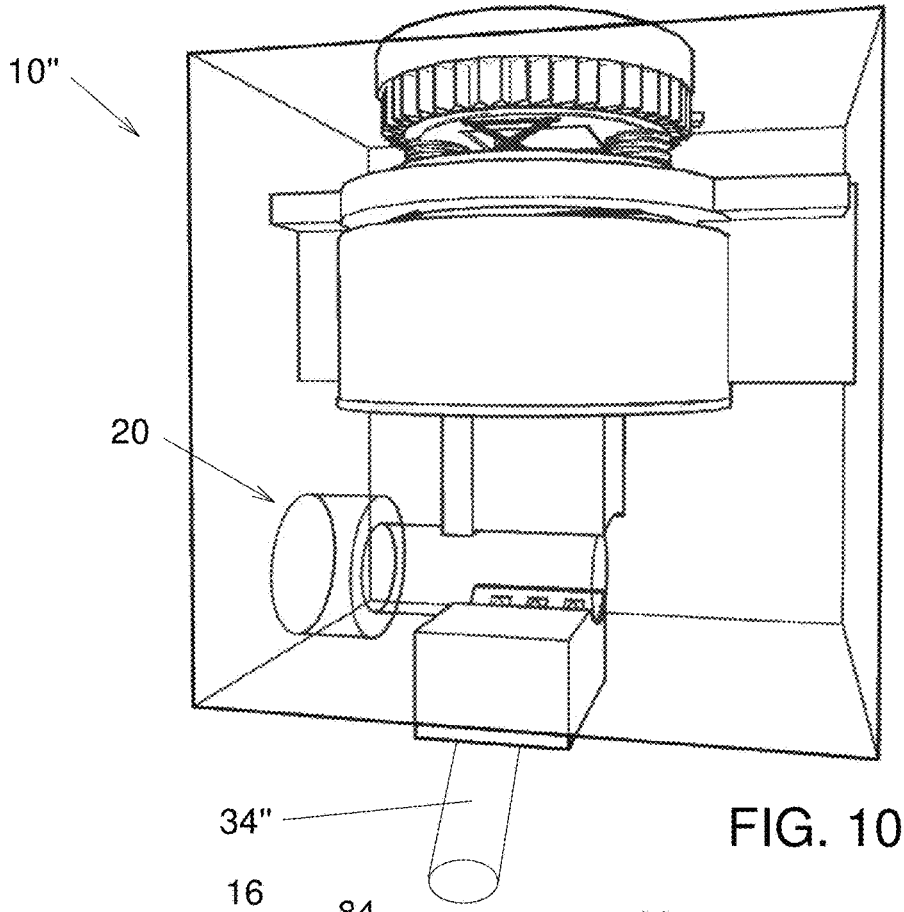
FIG. 10, in a top view with some hidden lines shown, illustrates a connector in accordance with yet another alternative embodiment of the present invention.

The connector 10 includes a connector body 16 in which are provided first and second terminals 18 and 20 for receiving respectively the first and second conductors 12 and 14. The first and second terminals 18 and 20 are respectively of first and second types and will be described in further details below. It should be noted that in alternative embodiments, terminals of the first and second types are mixed in any suitable number and manner. An alternative connector may include one or more terminal of the first type and/or one or more terminal of the second type, with either only one of the first and second type provided in the connector, or terminals of the first and second types mixed together in the connector, as illustrated for example in FIG. 1. As an example, FIG. 9 illustrate a connector 10' including four terminals 20 of the second type. FIG. 10 illustrates a connector 10" including only one terminal 20, which is here of the second type, but a terminal of the first type could also be used. The connector 10" is used to connect a conductor to a device in which electrical currents and/or signals are provided to a conductor 34" that is integral with the device. Therefore, only one terminal is required as the other conductor is already present in the device and therefore does not need to be connected thereto.

Figure 11:
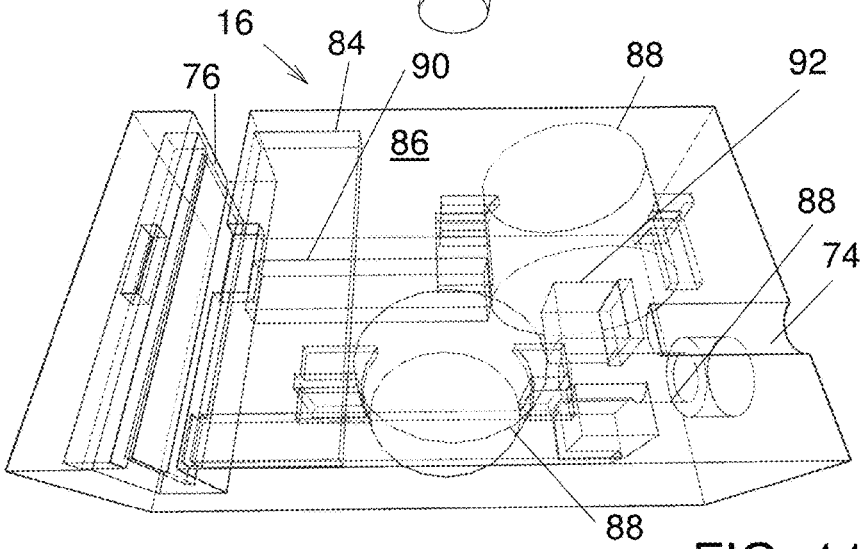
FIG. 11, in a perspective view with some hidden lines shown, illustrates a connector body part of the connector of FIGS. 1 to 5.

Also, in FIGS. 1 to 5, 9 and 10, the components that are received in the connector body 16 are shown in transparency without the structures that receive these components shown for clarity reasons. Suitable cavities and recesses are formed in the connector body 16 to receive these components, as shown in FIG. 11 and further described hereinbelow.

Figure 4:
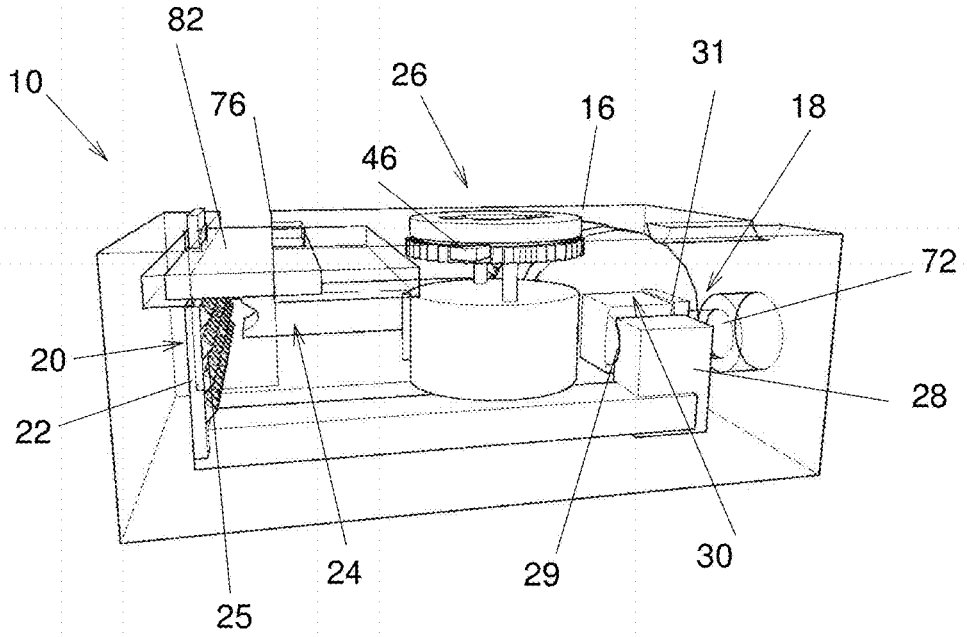
FIG. 4, in a rear view with some hidden lines shown, illustrates the connector of FIGS. 1 to 3.

The first terminal 18 includes a first electrical contact 22 made of an electrically conducting material, a first clamping element 24 for clamping the first conductor 12 against the first electrical contact by clamping the first conductor 12 between the first electrical contact 22 and the first clamping element 24, and a first actuator 26. The first clamping element 24 is movable between a first clamping element open configuration (as seen in FIG. 1) and a first clamping element closed configuration (as seen in FIG. 4). In the first clamping element closed configuration, the first clamping element 24 is closer to the first electrical contact 22 than in the first clamping element open configuration. The first actuator 26 is operatively coupled to the first clamping element 24 for selectively moving the first clamping element 24 between the first clamping element closed and open configurations.

Figure 2:
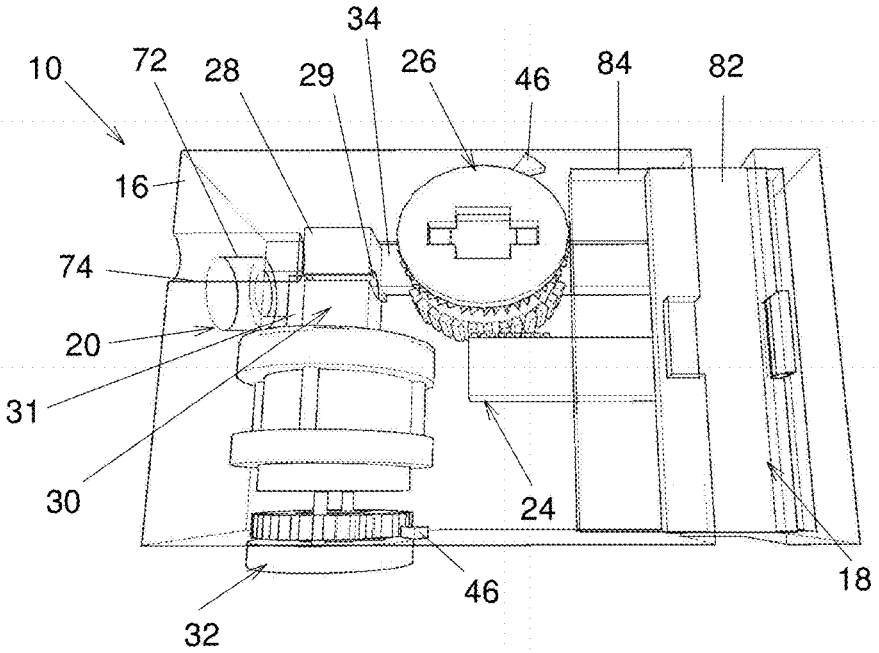
FIG. 2, in a top view with some hidden lines shown, illustrates the connector of FIG. 1 in a second configuration.
Figure 3:
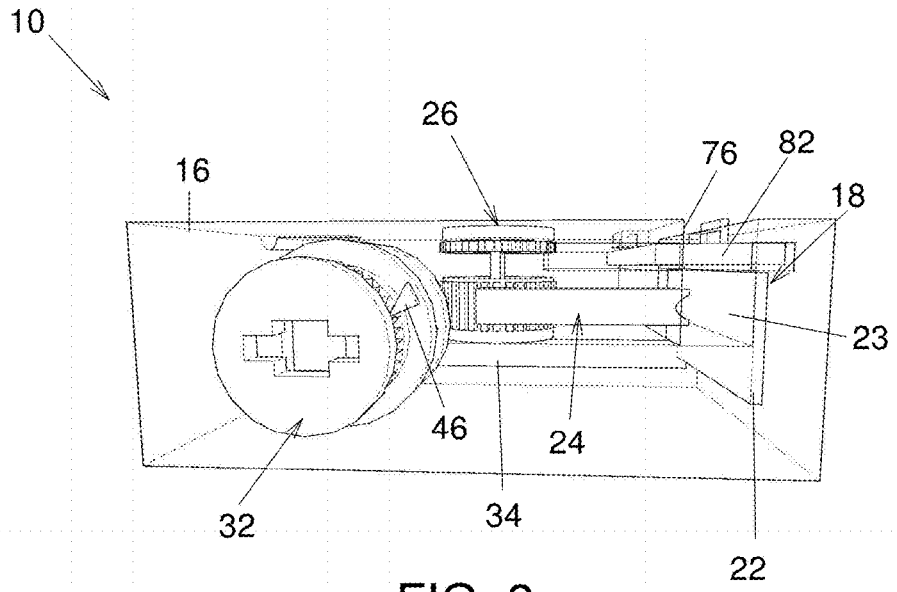
FIG. 3, in a front view with some hidden lines shown, illustrates the connector of FIGS. 1 and 2.

Similarly, the second terminal 20 is provided with a second electrical contact 28 made of an electrically conducting material, a second clamping element 30 for clamping the second conductor 14 against the second electrical contact 28 by clamping the second conductor 14 between the second electrical contact 28 and the second clamping element 30, and a second actuator 32. The second clamping element 30 is movable between a second clamping element open configuration (as seen in FIG. 1) and a second clamping element closed configuration (as seen in FIG. 2). In the second clamping element closed configuration, the second clamping element 30 is closer to the second electrical contact 28 than in the second clamping element open configuration. The second actuator 32 is operatively coupled to the second clamping element 30 for selectively moving the second clamping element 30 between the second clamping element closed and open configurations.

An electrically conducting element 34 extends between the first and second electrical contacts 22 and 28 and electrically couples the first and second electrical contacts 22 and 28 to each other. In some embodiments, the electrically conducting element 34, first electrical contact 22 and second electrical contact 28 extend integrally from each other. However, this is not necessarily the case in alternative embodiments of the invention. As seen for example in FIG. 9, the electrically conducting element 34 may also connect to each other more than one two electrical contacts 28' (four in FIG. 9). Also, in some embodiments, the electrically conducting element 34' may only connect to one electrical contact 28", as seen in FIG. 10, and the electrically conducting element 34" may be electrically coupled instead to other components (not shown in the drawings) of an electrical or electronic device.

At least one of the first and second actuators 26 and 32 is configurable between two configurations, one of which only allows closing of a gap 23 between the first electrical contact 22 and the first clamping element 24 and/or closing of a gap 29 between the second electrical contact 28 and the second clamping element 30. In this configuration, gaps 23 and/or 29 cannot be opened. In the other configuration, the gaps 23 and/or 29 can be opened, and in some embodiments, can be selectively opened or closed. In some embodiments, all the actuators present in the connector 10, 10' or 10" are configurable between these two configurations.

Figure 8A:
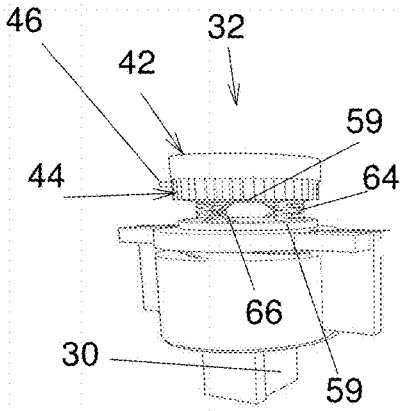
FIG. 8A, in a perspective cut away view, illustrates mounting of the actuators of FIGS. 6 and 7 in the connector of FIGS. 1 to 5 with a toothed wheel of the actuator in an engaged position.
Figure 8B:
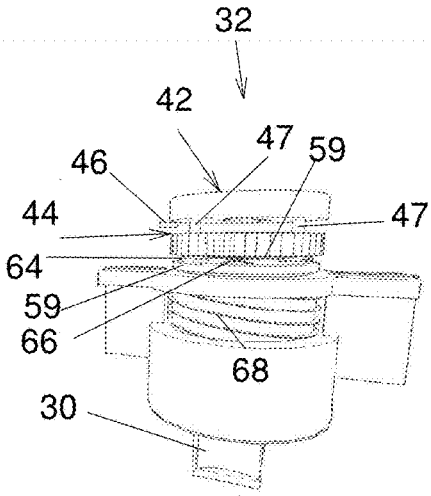
FIG. 8B, in a perspective cut away view, illustrates mounting of the actuators of FIGS. 6 and 7 in the connector of FIGS. 1 to 5 with the toothed wheel in a disengaged position.

More specifically, the second actuator 32 is configurable between a second actuator first configuration (as seen in FIG. 8A) and a second actuator second configuration (as seen in FIG. 8B). In the second actuator first configuration, the second actuator 32 is only operable to move the second clamping element 30 towards the second clamping element closed configuration, and in the second actuator second configuration, the second actuator 32 is operable to move the second clamping element 30 (not seen in FIGS. 8A and 8B) towards the second clamping element open configuration. In some embodiments, as shown in FIGS. 8A and 8B, in the second actuator second configuration, the second actuator 32 is operable to selectively move the second clamping element 30 towards each of the second clamping element closed and open configurations. The first and second configurations of the first actuator 26 are similar to the second actuator first and second configurations and are as such not shown in the drawings.

The first actuator 26 uses a rack and pinion type mechanism to move the first clamping element 24. More specifically, referring to FIGS. 5 and 6 for example, the first actuator 26 includes a toothed pinion 36 and the first clamping element 24 includes a substantially elongated toothed rack 38 engaging the toothed pinion 36 and defines a clamping surface 40 extending generally perpendicular to the toothed rack 38 and facing the first electrical contact 22. Rotating the toothed pinion 36 moves the toothed rack 38 relative to the toothed pinion 36 to move the clamping surface 40 relative to the first electrical contact 22, thereby moving the first clamping element 24 between the first clamping element open and closed configurations. The first actuator 26 and the first clamping element 24 are mounted in the connector body 16 in any suitable manner, for example in suitably shaped cavities formed in the connector body 16 defining flanges that maintain the first actuator 26 and the first clamping element 24 in these cavities.

The first actuator 26 also includes a head 42, the toothed pinion 36 being coaxial with the head and spaced apart therefrom. A toothed wheel 44 is movable axially relative to the head 42 between the head 42 and the toothed pinion 36. The toothed wheel 44 is also rotatable relative to the body jointly with the head 42 and the toothed pinion 36. A pawl 46 (seen for example in FIG. 1) is mounted to the connector body 16. The pawl 46 and toothed wheel 44 are configured and sized so that with the pawl 46 engaging the toothed wheel 44, the toothed wheel 44 is only rotatable in a first direction and is prevented by the pawl 46 from rotating in a second direction opposed to the first direction. The toothed wheel 44 is movable relative to the head 42 between an engaged position (seen in FIG. 8A) wherein the toothed wheel 44 engages the pawl 46, and a disengaged position (seen in FIG. 8B) wherein the toothed wheel 44 is disengaged from the pawl 46. The first actuator 26 is in a first actuator first configuration when the toothed wheel 44 is in the engaged position and the first actuator 26 is in a first actuator second configuration when the toothed wheel 44 is in the disengaged position.

Returning to FIG. 5, the head 42 is operatively coupled to the first clamping element 24 such that rotating the head 42 moves the first clamping element 24 between the first clamping element open and closed configurations, through a rack and pinion system, as described above. For example, the toothed wheel 44 is mounted to be slidable along pegs 47 extending between the pinion 36 and the head 42. Although only two pegs 47 are shown in the drawings, any suitable number of pegs 47 is usable in alternative embodiments of the invention.

Specific embodiments of the head 42 and toothed wheel 44 are now described in further details. The head 42 is substantially disc-shaped and defines a head aperture 48 extending therethrough leading to the toothed wheel 44. The head aperture 48 includes a head aperture moving portion 52 and a head aperture pass-through portion 50. As detailed hereinbelow, when a tool is inserted in the head aperture moving portion 52, the toothed wheel 44 can be moved between the toothed wheel engaged and disengaged positions. When a tool is engaged only through the head aperture pass-through portion 50, the toothed wheel 44 remains in the toothed wheel engaged position.

In some embodiments, the head aperture moving portion 52 extends outwardly from the head aperture pass-through portion 50. In a specific embodiment of the invention, the head aperture pass-through portion 50 is substantially square and the head aperture moving portion 52 takes the form of a pair of slits extending radially outwardly opposed to each other from the head aperture pass-through portion 50. In such embodiments, a conventional Robertson screwdriver may be used, inserted in the head aperture pass-through portion 50, to operate the first actuator 26 with the toothed wheel 44 in the toothed wheel engaged position, which only allows rotation of the head 42 in a single direction. Also, a conventional flat head screwdriver may be used, inserted in the head aperture moving portion 52 (and in part of the head aperture pass-through portion 50) to move the toothed wheel 44 to the toothed wheel disengaged position and rotate the head 42 in both directions. It should be noted that in other embodiments, the head aperture 48 may have any other suitable configurations, such that other tools are usable to operate the first actuator 26.

Figure 6:
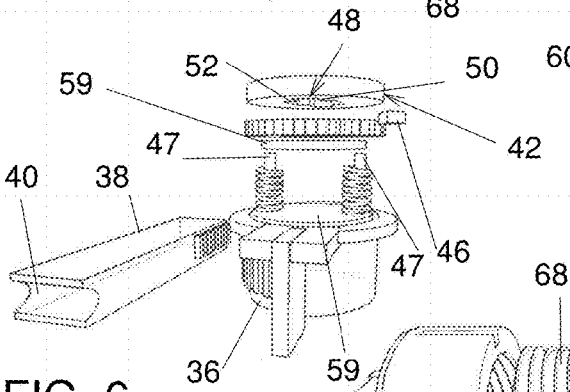
FIG. 6, in a perspective exploded view with some hidden lines shown, illustrates an actuator part of the connector of FIGS. 1 to 5.

Referring to FIG. 6, the toothed wheel 44 is also substantially disc-shaped and defines a toothed wheel abutment portion 54 in register with the head aperture moving portion 52, and a wheel pass-through aperture 56 in register with the head pass-through portion. Therefore, inserting a tool through the head aperture moving portion 52 and pushing against the toothed wheel abutment portion 54 with the tool moves the toothed wheel 44 to the toothed wheel disengaged position, while inserting a tool through the head aperture pass-through portion 50 and through the wheel pass-through aperture 56 leaves the toothed wheel unaffected in the toothed wheel engaged position.

Returning to FIG. 5, the toothed wheel 44 defines a plurality of teeth 58 along its circumference. Each of the teeth 58 defines a radial surface 60 extending substantially radially and a slanted surface 62 angled relative to the radial surface 60 and merging with the radial surface 60. The pawl 46 is configured and sized so that when the toothed wheel 44 is rotated in the first direction, the pawl 46 can climb the slanted surface 62 to allow rotation of the toothed wheel 44 in the first direction, and when the toothed wheel 44 is rotated in the second direction, the pawl 46 stops rotation of the toothed wheel 44 when abutting against the radial surface 60. This is achieved by having a pawl 46 that can deform or move relative to the toothed wheel 44, while being biased generally towards the center of the toothed wheel 44, and which is suitably angled relative to the radial and slanted surfaces 60 and 62, as in the conventional pawl and ratchet mechanism.

One or more actuator biasing element 59, 64 and 66 biases the toothed wheel 44 towards the engaged position. In the embodiment shown in the drawings, the actuator biasing element 59, 64 and 66 is omitted from most figures for clarity reasons and is only shown in FIGS. 6, 7, 8A and 8B. For example, the actuator biasing element 59, 64 and 66 includes one or more coil spring 64 mounted coaxial with the pegs 47 between the toothed wheel 44 and the pinion 36, or shaft 68, as seen in FIGS. 8A and 8B. In another example, the actuator biasing element 59, 64 and 66 includes a resiliently collapsible polymer element 66 provided between the toothed wheel 44 and the pinion 36, or shaft 68, as seen in FIGS. 8A and 8B. In some embodiments, the actuator biasing element 59, 64 and 66 takes the form of magnets 59 provided between the toothed wheel 44 and either the pinion 36 or a shaft 68 (described hereinbelow) with polarities aligned so that the toothed wheel 44 is repulsed towards the head 42. Although FIGS. 8A and 8B illustrate three types of actuator biasing element 59, 64 and 66, only one type or two types may be provided in some embodiments of the invention. The actuator biasing element 59, 64 and 66 may also take any other suitable form.

The second actuator 32 is similar in many respects to the first actuator 26, and only the differences therewith are described in details. More specifically, instead of using a rack and pinion mechanism, the second actuator 32 uses a screw mechanism. The first actuator 26 drives the clamping surface 40 in a direction perpendicular to the rotation axis of the head 42, but the second actuator 32 drives the clamping surface 40 in a direction coaxial with the rotation axis of the head 42.

Figure 5:
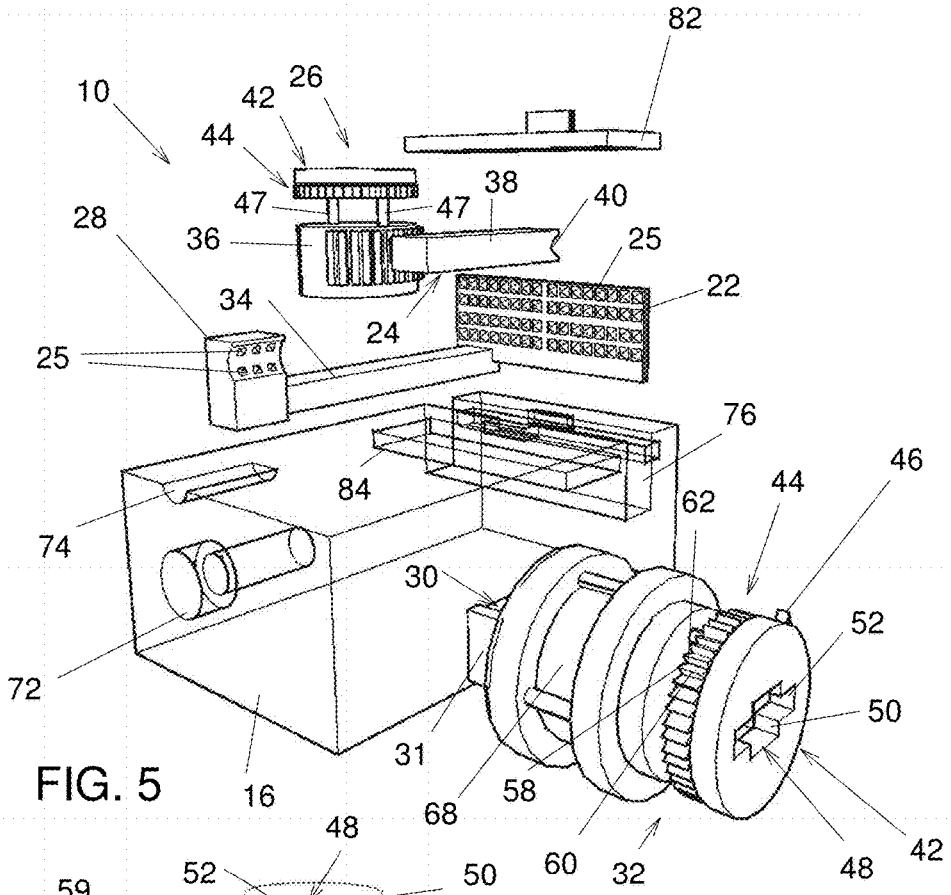
FIG. 5, in a perspective partially exploded view with some hidden lines shown, illustrates the connector of FIGS. 1 to 4.
Figure 7:
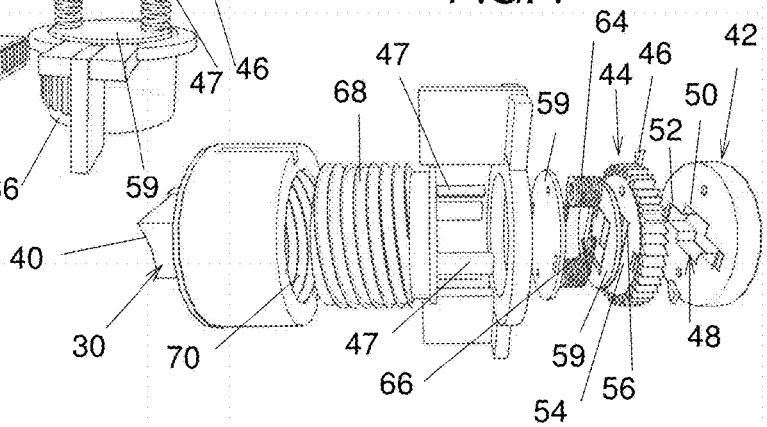
FIG. 7, in a perspective exploded view with some hidden lines shown, illustrates an alternative actuator part of the connector of FIGS. 1 to 5.

More specifically, referring to FIGS. 5 and 7, the second actuator 32 includes a shaft 68 terminated by the head 42, with the pegs 47 therebetween. The shaft 68 is threaded along a threaded portion thereof, which may be the whole shaft 68 in some embodiments. The second clamping element 30 defines a threaded aperture 70 threadedly receiving at least part of the threaded portion of the shaft 68 thereinto and the second clamping 30 element defines a clamping surface 40 opposed to the head 42 and facing the second electrical contact 28. The shaft 68 is mounted to the connector body 16 in an aperture so that the shaft 68 is longitudinally fixed relative to the connector body 16. Rotating the shaft 68 relative to the threaded aperture 70, using the head 42, moves the clamping surface 40 relative to the second clamping element 30 to move the second clamping element 30 between the second clamping element open and closed configurations. Otherwise, the second actuator 32 is structured and operates similarly to the first actuator 26.

The first and second terminals 18 and 20 receive the first and second conductors 12 and 14 differently. The first terminal includes a substantially elongated groove 76 leading into the connector body 16. The first electrical contact 22 and the first clamping element 24 face each other across the groove 76. The groove 76 is typically open at one or both longitudinal ends 78 and 80 thereof.

In some embodiments, the first terminal 18 is provided with a door 82 for selectively covering the groove 76 while leaving the groove 76 open at one of both longitudinal ends 78 and 80. The door 82 is movable between door open and closed configurations, shown in FIGS. 1 and 2 respectively. To the effect, the door slides in and out of a suitable shaped door receiving recess 84 provided in the connector body 16 across the groove 76. In some embodiments (not shown in the drawings), the door 82 is movable jointly between the door open and closed configurations with the first clamping element 24. In other embodiments, the door 82 is movable independently from the first clamping element 24.

Although the first terminal 18, first clamping element 24 and first actuator 26 are usable to receive a free end of the first conductor 12 and connect thereto, the first terminal 18, first clamping element 24 and first actuator 26 are also suitable for use in a spliceless connection in which the first conductor 12 is received in the connector 10 sideways, away from its free end.

The clamping surface 40 and the first and second electrical contacts 22 and 26 may have a substantially flat configuration, a substantially arcuate configuration for matching the shape of the first and second conductors 12 and 14, or any other suitable configuration. The clamping surface 40 and the first and second electrical contacts 22 and 26 may have, for example a substantially smooth surface at the contact with the first and second conductors 12 and 14, or define a contact surface for contacting the first and second conductors 12 and 14 that are provided with asperities 25, or is otherwise textured to improve grip with the first and second conductors 12 and 14.

The second terminal 20 includes a substantially elongated bore 72 leading into the connector body 16 and the second electrical contact 28 and the second clamping element 30 face each laterally other across the bore 72. Therefore the second conductor 14 is inserted longitudinally in the bore 72 when a connection is made. In some embodiments, a groove 74, or any other guide, is formed on the connector body 16 with a length similarly similar to the depth of the bore 72, which helps in stripping the end of the second conductor 14 along a suitable length.

In some embodiments, an obstructing element 31 is provided adjacent the second clamping element 30 and movable jointly therewith. The obstructing element 31 is configured to extend across the bore 72 to prevent access to the second electrical contact 28 when fully extended across the bore 72. In some embodiments, the obstructing element 31 is resiliently deformable, made for example of rubber, so that when the second conductor 14 is inserted in the bore 72, the obstructing element 31 can deform to accommodate the presence of the second conductor 14 in the bore 72 when the second clamping element 28 is pushed against the second conductor 14. In addition, in such cases, using a suitable configuration and suitable material properties for the obstructing element also enhances the gripping force exerted on the second conductor 14.

FIG. 11 illustrates an example of the actuator body 16 with all the required cavities shown. Other cavities may be provided, for example to reduce the quantity of material required to manufacture the actuator body 16 or to facilitate assembly of the connector 10.

The actuator body 16 defines a body outer surface 86. The groove 76 and bore 72 extend from the body outer surface 86 into the actuator body 16, and the door receiving recess 84 extend from the groove 76 into the actuator body 16.

A pair of actuator receiving recesses 88 extend from the body outer surface 86 to receive the first and second actuators 26 and 32 thereinto and are configured to allow access to the head 42 from outside the connector 10 and allow the latter head to rotate relative to the actuator body while maintaining the first and second actuators 26 and 32 at a fixed position in the actuator body 16. Clamping element receiving recesses 90 and 92 extend between a respective one of the actuator receiving recesses 88 and respectively the groove 76 and bore 72 to receive thereinto the first and second clamping elements 24 and 30 so that the first and second clamping elements 24 and 30 are movable along the clamping element receiving recesses 90 and 92.

Although not shown in the drawings, in some embodiments, an indicator, such as a light emitting diode (LED), is provided to indicate that current is flowing through the conducting element 34. Typically, all elements of the connector 10, except for the first and second electrical contacts 22 and 28 and the conducting element 34 are made of an insulator, such as a polymer. However, in other embodiments, additional parts of the connector 10 are conducting.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A connector for electrically connecting to a first conductor, the connector comprising:

a first terminal for receiving the first conductor, the first terminal being provided with a first electrical contact made of an electrically conducting material, a first clamping element for clamping the first conductor against the first electrical contact by clamping the first conductor between the first electrical contact and the first clamping element, and a first actuator, the first clamping element being movable between a first clamping element open configuration and a first clamping element closed configuration, wherein, in the first clamping element closed configuration, the first clamping element is closer to the first electrical contact than in the first clamping element open configuration, the first actuator being operatively coupled to the first clamping element for selectively moving the first clamping element between the first clamping element closed and open configurations; and an electrically conducting element extending from and electrically coupled to the first electrical contact;

the first actuator being configurable between a first actuator first configuration and a first actuator second configuration, wherein, in the first actuator first configuration, the first actuator is only operable to move the first clamping element towards the first clamping element closed configuration, and in the first actuator second configuration, the first actuator is operable to move the first clamping element towards the first clamping element open configuration, the first actuator first configuration being achievable at any position of the first clamping element between the first clamping element open and closed positions.

2. The connector as defined in claim 1, wherein the connector is usable for electrically connecting the first conductor and a second conductor to each other, the connector further comprising:

a second terminal for receiving the second conductor, the second terminal being provided with a second electrical contact made of an electrically conducting material, a second clamping element for clamping the second conductor against the second electrical contact by clamping the second conductor between the second electrical contact and the second clamping element, and a second actuator, the second clamping element being movable between a second clamping element open configuration and a second clamping element closed configuration, wherein, in the second clamping element closed configuration, the second clamping element is closer to the second electrical contact than in the second clamping element open configuration, the second actuator being operatively coupled to the second clamping element for selectively moving the second clamping element between the second clamping element closed and open configurations;

wherein the electrically conducting element extends between the first and second electrical contacts and electrically couples the first and second electrical contacts to each other.

3. The connector as defined in claim 1, wherein, in the first actuator second configuration, the first actuator is operable to selectively move the first clamping element towards each of the first clamping element closed and open configurations.

4. The connector as defined in claim 3, wherein the first actuator includes a shaft terminated by a head, the shaft being threaded along a threaded portion thereof;

the first clamping element defines a threaded aperture threadedly receiving at least part of the threaded portion thereinto, the first clamping element defining a clamping surface opposed to the head and facing the first electrical contact; and rotating the shaft relative to the threaded aperture moves the clamping surface relative to the first electrical contact to move the first clamping element between the first clamping element open and closed configurations.

5. The connector as defined in claim 3, wherein the first actuator includes a toothed pinion;

the first clamping element includes a substantially elongated toothed rack engaging the toothed pinion and defines a clamping surface extending generally perpendicular to the toothed rack; and rotating the toothed pinion moves the toothed rack relative to the toothed pinion to move the clamping surface relative to the first electrical contact to move the first clamping element between the first clamping element open and closed configurations.

6. The connector as defined in claim 5, wherein the toothed pinion is coaxial with the head.

7. The connector as defined in claim 3, further comprising a connector body, the first actuator being mounted to the connector body, the first actuator including a head and a toothed wheel movable axially relative to the head, the toothed wheel being also rotatable relative to the connector body jointly with the head, the first actuator also including a pawl mounted to the connector body, the pawl and toothed wheel being configured and sized so that with the pawl engaging the toothed wheel, the toothed wheel is only rotatable in a first direction and is prevented by the pawl from rotating in a second direction opposed to the first direction, the toothed wheel being movable relative to the head between an engaged position wherein the toothed wheel engages the pawl, and a disengaged position wherein the toothed wheel is disengaged from the pawl, the head being operatively coupled to the first clamping element such that rotating the head moves the first clamping element between the first clamping element open and closed configurations, the first actuator being in the first actuator first configuration when the toothed wheel is in the engaged position and the first actuator being in the first actuator second configuration when the toothed wheel is in the disengaged position.

8. The connector as defined in claim 7, wherein the toothed wheel includes a plurality of teeth, each of the teeth defining a radial surface extending substantially radially and a slanted surface angled relative to the radial surface and merging with the radial surface, the pawl being configured and sized so that when the toothed wheel is rotated in the first direction, the pawl can climb the slanted surface to allow rotation of the toothed wheel in the first direction and when the toothed wheel is rotated in the second direction, the pawl stops rotation of the toothed wheel when abutting against the radial surface.

9. The connector as defined in claim 7, wherein the first actuator includes an actuator biasing element biasing the toothed wheel towards the engaged position.

10. The connector as defined in claim 9, wherein the head defines a head aperture extending therethrough leading to the toothed wheel, the head aperture including a head aperture moving portion and the toothed wheel defining a toothed wheel abutment portion in register with the head aperture moving portion, whereby inserting a tool through the head aperture moving portion and pushing against the toothed wheel abutment portion with the tool moves the toothed wheel to the toothed wheel disengaged position.

11. The connector as defined in claim 10, wherein the head aperture also includes a head aperture pass-through portion and the toothed wheel defines a wheel pass-through aperture in register with the head pass-through portion.

12. The connector as defined in claim 11, wherein the head aperture moving portion extends outwardly from the head aperture pass-through portion.

13. The connector as defined in claim 12, wherein the head aperture pass-through portion is substantially square and the head aperture moving portion includes a slit.

14. The connector as defined in claim 1, wherein the first clamping element defines a concave clamping surface facing the first electrical contact.

15. The connector as defined in claim 1, further comprising a connector body, the first terminal being provided in the connector body and including a substantially elongated bore leading into the connector body, the first electrical contact and the first clamping element facing each laterally other across the bore.

16. The connector as defined in claim 1, further comprising a connector body, the first terminal being provided in the connector body and including a substantially elongated groove leading into the connector body, the first electrical contact and the first clamping element facing each other across the groove.

17. The connector as defined in claim 16, wherein the groove is open at at least one longitudinal end thereof, the first terminal being provided with a door for selectively covering the groove while leaving the groove open at the at least one longitudinal end.

18. The connector as defined in claim 1, wherein the first electrical contact defines a first contact surface for contacting the first conductor, the first contact surface being concave.

19. The connector as defined in claim 1, wherein the first electrical contact defines a first contact surface for contacting the first conductor, the first contact surface being provided with asperities.

20. A connector for electrically connecting to a conductor, the connector comprising:

a terminal for receiving the conductor, the terminal being provided with an electrical contact made of an electrically conducting material, a clamping element for clamping the conductor against the electrical contact by clamping the conductor between the electrical contact and the clamping element, and a actuator, the clamping element being movable between a clamping element open configuration and a clamping element closed configuration, wherein, in the clamping element closed configuration, the clamping element is closer to the electrical contact than in the clamping element open configuration, the actuator being operatively coupled to the clamping element for selectively moving the clamping element between the clamping element closed and open configurations; and an electrically conducting element extending from and electrically coupled to the first electrical contact;

the actuator being configurable between an actuator first configuration and an actuator second configuration, wherein, in the actuator first configuration, the actuator is only operable to move the clamping element towards the clamping element closed configuration, and in the actuator second configuration, the actuator is operable to move the clamping element towards the clamping element open configuration, the actuator being configurable between the actuator first and second configurations with the clamping element between the clamping element open and closed positions;

the connector further comprising a connector body, the terminal being provided in the connector body and including a substantially elongated bore leading into the connector body, the electrical contact and the clamping element facing each laterally other across the bore;

the connector also further comprising an obstructing element provided adjacent the clamping element and movable jointly therewith, the obstructing element being configured to extend across the bore to prevent access to the first electrical contact when fully extended across the bore.

* * * * *